US008340546B2

(12) United States Patent
Washington

(10) Patent No.: US 8,340,546 B2
(45) Date of Patent: Dec. 25, 2012

(54) DUAL FUNCTION CHARGING DEVICE AND CHARGE PATTERNING DEVICE CLEANER

(75) Inventor: John Roy Washington, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 340 days.

(21) Appl. No.: 12/754,825

(22) Filed: Apr. 6, 2010

(65) Prior Publication Data

US 2011/0243597 A1 Oct. 6, 2011

(51) Int. Cl.
*G03G 15/02* (2006.01)
*G03G 21/00* (2006.01)

(52) U.S. Cl. ..... 399/99; 399/100

(58) Field of Classification Search ..... 399/98, 399/99, 100, 115, 118, 168, 177, 71
See application file for complete search history.

(56) References Cited

U.S. PATENT DOCUMENTS 4,841,146 A 6/1989 Gundlach et al.
5,485,251 A 1/1996 Kita et al.
6,205,303 B1 * 3/2001 Fujii et al. ..... 399/100
7,248,812 B2 * 7/2007 Tombs ..... 399/98
7,898,559 B2 * 3/2011 Kobayashi ..... 347/158
7,978,990 B2 * 7/2011 Tajima ..... 399/36
2008/0061499 A1 3/2008 DeGruchy et al.
2008/0069589 A1 3/2008 Chang et al.
2009/0009573 A1 1/2009 Larson et al.
2009/0087210 A1 * 4/2009 Terao et al. ..... 399/99
2010/0028040 A1 2/2010 Gross et al.
2012/0002999 A1 * 1/2012 Itabashi ..... 399/100

* cited by examiner

*Primary Examiner* — Robert Beatty
(74) *Attorney, Agent, or Firm* — Gibb & Riley, LLC

(57) ABSTRACT

A printing apparatus includes a charging device and a photoreceptor adjacent the charging device. The charging device transfers a charge to the photoreceptor. Also, a charge patterning device is adjacent the photoreceptor. The patterning device patterns the charge on the photoreceptor to form a latent image charge. Additionally, an automated cleaning device is adjacent the charging device. The charge patterning device periodically moves by the charging device and the charge patterning device to simultaneously clean the charging device and the charge patterning device.

20 Claims, 3 Drawing Sheets

DUAL FUNCTION CHARGING DEVICE AND CHARGE PATTERNING DEVICE CLEANER

BACKGROUND AND SUMMARY

Embodiments herein generally relate to printing devices that utilize charging devices and patterning devices that pattern the charge on a photoreceptor, and more particularly to embodiments that include a dual function cleaner that simultaneously cleans both the charging elements and the patterning elements.

Electrostatic printing devices generally create a uniform charge on a photoreceptor using charging devices such as a corona charging device or a scorotron charging device and then patterned that charge using a patterning device (which can comprise, for example, a laser based raster output scanner (ROS)). The charging device needs to be cleaned on a regular basis and, therefore, auto-cleaning devices for the corona or scorotron devices have been developed. See for example, U.S. Patent Publication Number 2008/0069586, the complete disclosure of which is incorporated herein by reference.

However, improved printing quality can also be achieved by periodically cleaning the patterning devices (ROS). However, such cleaning processes are manually performed and are therefore expensive, sometimes performed inconsistently, and sometimes not performed when needed. Therefore, the embodiments described below provide a device and method whereby the patterning devices are cleaned each time the charging devices are cleaned, and such embodiments utilizes a single device to perform both operations, thereby decreasing costs and increasing reliability. By consistently cleaning the latent image patterning devices, the image quality consistently remains at a high level.

One generalized embodiment herein is a printing apparatus that includes a charging device and a photoreceptor adjacent the charging device. The charging device transfers a charge to the photoreceptor. Also, a charge patterning device is adjacent the photoreceptor. The patterning device patterns the charge on the photoreceptor to form a latent image charge.

A marking material donor device is adjacent the photoreceptor. The marking material donor device transfers marking material to areas of the photoreceptor having the latent image charge, such that the marking material is patterned into an image pattern according to the latent image charge on the photoreceptor. A sheet transport device is adjacent the photoreceptor. The sheet transport device supplies at least one sheet of media to the photoreceptor. The photoreceptor transfers the marking material to the sheet of media in the image pattern. A heating device is adjacent the photoreceptor, the heating device permanently attaches the marking material to the sheet of media in the image pattern.

Additionally, an automated cleaning device is adjacent the charging device. The charge patterning device periodically moves by the charging device and the charge patterning device to simultaneously clean the charging device and the charge patterning device.

Another more specific embodiment herein is a printing apparatus that utilizes a corona, corotron, or scorotron charging device, and a photoreceptor adjacent the corona charging device. The charging device transfers a charge to the photoreceptor. Further, a raster output scanner (ROS) is adjacent the photoreceptor. The raster output scanner patterns the charge on the photoreceptor to form a latent image charge.

A marking material donor roll is adjacent the photoreceptor, the marking material donor roll transfers marking material to areas of the photoreceptor having the latent image charge, such that the marking material is patterned into an image pattern according to the latent image charge on the photoreceptor.

Also, a sheet transport device is adjacent the photoreceptor, the sheet transport device supplies at least one sheet of media to the photoreceptor. The photoreceptor transfers the marking material to the sheet of media in the image pattern. A fuser is adjacent the photoreceptor, and the fuser permanently attaches the marking material to the sheet of media in the image pattern.

Again, an automated cleaning device is adjacent the charging device and the raster output scanner. The automated cleaning device periodically moves by the charging device and the raster output scanner to simultaneously clean the corona charging device and the raster output scanner. The printing apparatus produces debris from the sheet of media and the marking material, that collects on the raster output scanner, the cleaning device removes the debris from the raster output scanner.

In one embodiment, the automated cleaning device comprises a brush that is positioned to pass over the raster output scanner as the automatic cleaning device moves by the charging device. More specifically, the raster output scanner has an outer covering and the brush has a shape and size that matches the outer covering of the raster output scanner. In another embodiment, the brush can comprise a rotating fibrous surface having fibers sized to catch and hold the debris.

With printing devices according to embodiments herein, the charging device and the raster output scanner are positioned in sufficiently close proximity to one another to allow the automated cleaning device to simultaneously clean the charging device and the raster output scanner.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, improve printing quality can be achieved by periodically cleaning the charge patterning devices (ROS). The charge patterning devices are sometimes located beneath other printing elements, and contamination tends to fall onto the charge patterning devices, causing image quality defects. However, such cleaning processes are manually performed and are therefore expensive, sometimes performed inconsistently, and sometimes not performed when needed.

The embodiments herein utilize an existing cleaning device (the scorotron autocleaner) to provide cleaning of the charged patterning devices. While the embodiments herein increase the cost of production by requiring that the charging device and charge patterning device be located in somewhat close proximity, and by including additional cleaning elements in the existing cleaning devices, such costs are outweighed by the increase in performance and reliability provided by the embodiments herein.

Figure 1:
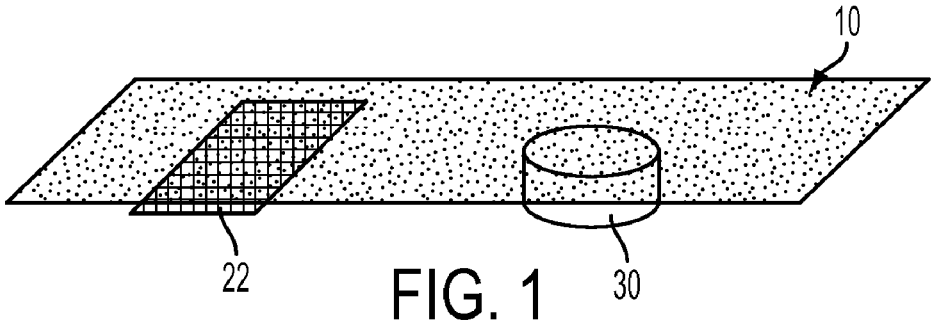
FIG. 1 is a perspective-view schematic diagram of a device according to embodiments herein.

As illustrated in perspective view in FIG. 1, one exemplary embodiment herein is a printing apparatus that utilizes any form of charging device 22, such as a corona, corotron, or scorotron charging device. As would be understood by those ordinarily skilled in the art, while a limited number of charging devices are discussed above, the embodiments herein are applicable to all charging devices, whether currently known or developed in the future.

A photoreceptor belt or roll 10 is adjacent the corona charging device 22. Note that in the drawings the photoreceptor 10 is shown in a partially transparent manner to allow the features that are position below the photoreceptor 10 to be more easily seen. Again, the photoreceptor 10 can comprise any form of photoreceptor, whether currently known or developed in the future. As illustrated by the upward arrows in cross-sectional view in FIG. 4, the charging device 22 transfers a blanket uniform static charge to the photoreceptor 10.

Further, a charge patterning device 30, such as raster output scanner (ROS) or any other charge patterning device is adjacent the photoreceptor 10. The raster output scanner 30 can utilize, for example, a laser or other electromagnetic radiation source to alter the uniform blanket charge that is created on the photoreceptor 10 by the charging device 22. Such a laser is illustrated by the angled arrows in cross-sectional view in FIG. 4.

As is understood by those ordinarily skilled in the art, light and other electromagnetic radiation is utilized to alter the pattern of charges on the photoreceptor 10. The charge patterning device 30 is not limited to conventionally known charge patterning devices, but instead includes all conventional charge patterning devices and charge patterning devices that are developed in the future. The raster output scanner 30 patterns the charge on the photoreceptor 10 to form a latent image charge.

Figure 2:
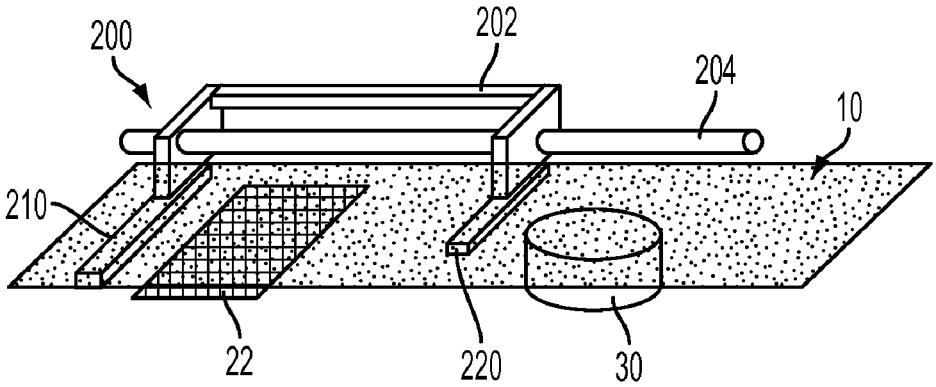
FIG. 2 is a perspective-view schematic diagram of a device according to embodiments herein.

FIG. 2 illustrates an automated cleaning device 200 that is positioned adjacent the charging device 22 and the raster output scanner 30. More specifically, in this example, the automated cleaning device 200 includes a support rail 204 and a frame 202 which moves along the support rail 204. Various brush extensions 210, 220 are connected to the frame 202. As would be understood by those ordinarily skilled in the art, the frame and brush extensions that are illustrated in the drawings are merely one example of shapes that could be utilized, and are not limiting. Therefore, the frame 202, rail 204, brush extensions 210, 220, and other features could take any shape and are not limited to the shapes illustrated. More specifically, different printing devices will have items spaced at different locations and will have different space constraints. The frame, rail, etc., utilized in such devices will be shaped to accommodate the available spaces. The embodiments herein are intended to encompass all frame shapes, all rail shapes, all brush extension shapes, etc., and are not limited to the specific shapes shown in the drawings.

Figure 3:
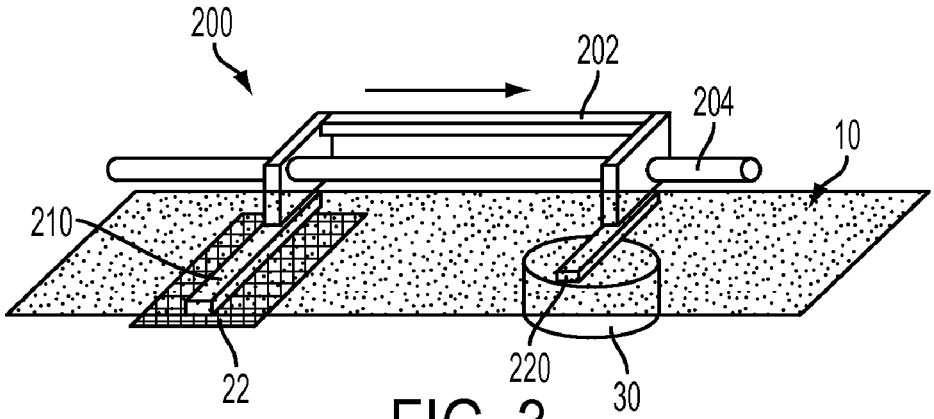
FIG. 3 is a perspective-view schematic diagram of a device according to embodiments herein.

As shown in FIG. 3, the frame 202 of the automated cleaning device 200 periodically moves along the rail 204 when performing a cleaning operation of the charging device 22 and the charge patterning device 30. This operation can be controlled by, for example, the controller 29 that is described below. When the frame 202 moves, this moves the brush extensions 210, 220 by the charging device 22 and the raster output scanner 30 to simultaneously clean the charging device 22 and the raster output scanner 30.

Thus, the printing apparatus produces debris from the sheets of media and the marking material, that collects on the raster output scanner 30. The brushes 210, 220 remove the debris from the raster output scanner 30. Therefore, in one exemplary embodiment, the automated cleaning device 200 comprises a brush 220 that is positioned to pass over the raster output scanner 30 as the automatic cleaning device 200 moves by the charging device 22. More specifically, the raster output scanner 30 has an outer covering and the brush 220 has a shape and size that matches the outer covering of the raster output scanner 30.

Figure 4:
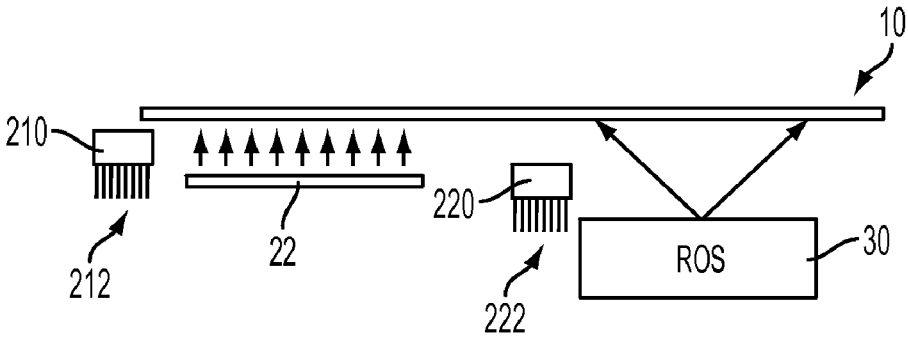
FIG. 4 is a side-view schematic diagram of a device according to embodiments herein.
Figure 5:
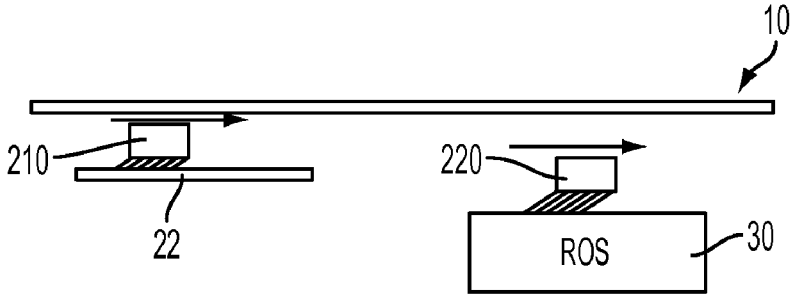
FIG. 5 is a side-view schematic diagram of a device according to embodiments herein.
Figure 6:
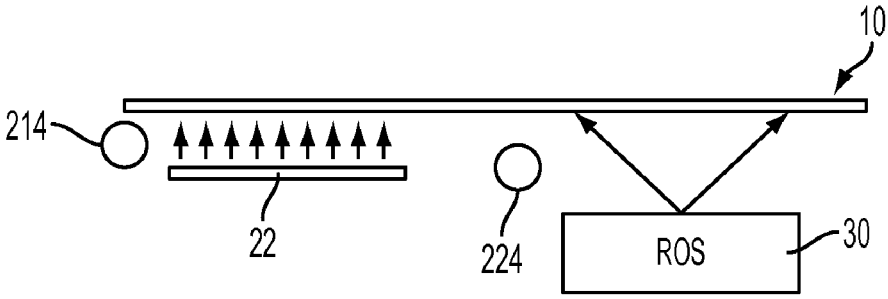
FIG. 6 is a side-view schematic diagram of a device according to embodiments herein.

This is also shown in cross-sectional view in FIGS. 4 and 5 where the brush extensions 210, 220 are illustrated as having brush tips 212, 222 that contact the charging device 22 and the charge patterning device 30. As would be understood by those ordinarily skilled in the art, items 212 and 222 can represent any form of cleaning surface, such as fiber materials, cloths, squeegees, knifes, etc., and the embodiments herein are not limited to brushes, but are intended to include any device or substance that can remove debris from the surface, whether currently known or developed in the future. Therefore, as shown in FIG. 6, in one exemplary alternative embodiment, the material removal features can comprise rotating fibrous surfaces 214, 224 having fibers sized to catch and hold the debris.

Thus, with printing devices according to embodiments herein, the charging device 22 and the raster output scanner 30 are positioned in sufficiently close proximity to one another to allow the automated cleaning device 200 to simultaneously clean the charging device 22 and the raster output scanner 30 as the automated cleaning device 200 moves by the charging device 22 and raster output scanner 30. Therefore, these embodiments provide a device and method whereby the patterning devices are cleaned each time the charging devices are cleaned, and such embodiments utilizes a single device to perform both operations, thereby decreasing costs and increasing reliability. By consistently cleaning the latent image patterning devices, the image quality consistently remains at a high level.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "printing device" as used herein encompasses any apparatus, such as a digital copier, bookmaking machine, facsimile machine, multi-function machine, etc. which performs a print outputting function for any purpose. The embodiments herein specifically applied to any direct-to-paper technology (xerographic, inkjet, etc.). The details of printers, printing engines, etc., are well-known by those ordinarily skilled in the art and are discussed in, for example, U.S. Patent Publication 2008/0061499, the complete disclosure of which is fully incorporated herein by reference.

Figure 7:
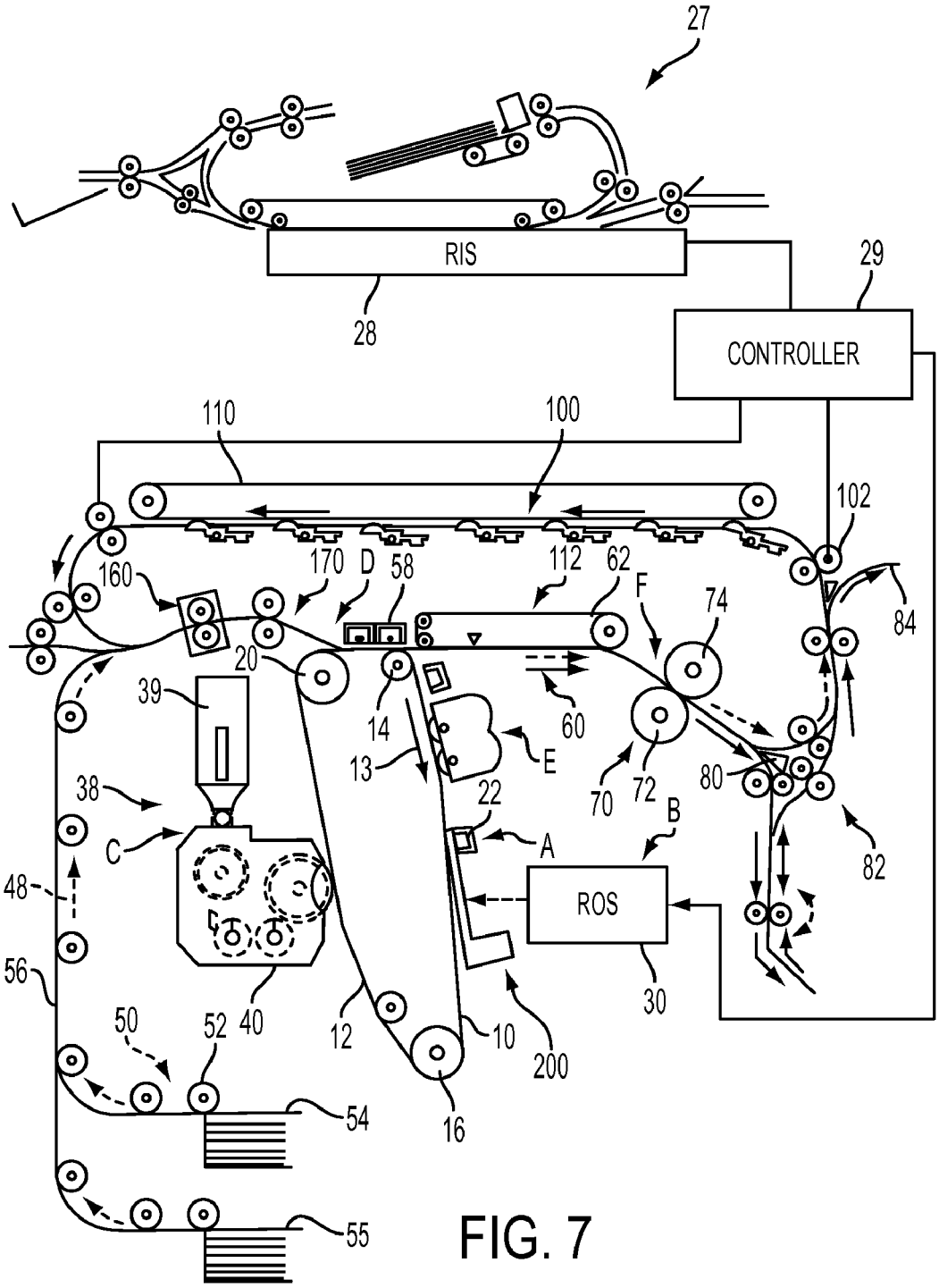
FIG. 7 is a side-view schematic diagram of a device according to embodiments herein.

While FIG. 7 describes an electrophotographic printing machine, those ordinarily skilled in the art would understand that the present embodiments are equally applicable to any form of printing machine, whether now known or developed in the future. For example, the embodiments herein are especially applicable to direct printing architectures including inkjet-based printing, ribbon-based printing, etching, etc. For a full discussion of one example of direct printing architectures see U.S. Patent Publication Number 2009/0009573 and the patents and publications listed therein (the complete disclosures of which are incorporated herein by reference).

For example, FIG. 7 schematically depicts an electrophotographic printing machine that is similar to one described in U.S. Patent Publication 2008/0061499. It will become evident from the following discussion that the present embodiments may be employed in a wide variety of devices and is not specifically limited in its application to the particular embodiment depicted in FIG. 7.

FIG. 7 schematically depicts an electrophotographic printing machine incorporating the features of the present disclosure therein. It will become evident from the following discussion that the device 200 of the present disclosure may be employed in wide variety of devices and is not specifically limited in its application to the particular embodiments depicted herein.

FIG. 7 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 7 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station C, where toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 7, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 and 53 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor 10 in a timed sequence so that the toner powder image formed thereon contacts the advancing sheet 48 at transfer station D. The vertical transport 56 can comprise a vacuum belt 222 that is discussed above. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 210, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. Further, the controller 29 includes a computer readable storage medium that stores instructions that are executed by the controller to allow the printing device to perform the various functions that are described herein.

Thus, as shown above, a marking material donor roll 40 is adjacent the photoreceptor 10, the marking material donor roll 40 transfers marking material to areas of the photoreceptor 10 having the latent image charge, such that the marking material is patterned into an image pattern according to the latent image charge on the photoreceptor 10. Also, a sheet transport device 170 is adjacent the photoreceptor 10, the sheet transport device supplies at least one sheet of media 54, 55 to the photoreceptor 10. The photoreceptor 10 transfers the marking material to the sheets of media in the image pattern. A fuser F is adjacent the photoreceptor 10, and the fuser permanently attaches the marking material to the sheet of media in the image pattern.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. A printing apparatus comprising:

a charging device;

a photoreceptor adjacent said charging device, said charging device transferring a charge to said photoreceptor;

a charge patterning device adjacent said photoreceptor, said charge patterning device patterning said charge on said photoreceptor to form a latent image charge; and an automated cleaning device adjacent said charging device and said charge patterning device, said automated cleaning device comprising a frame, and a first cleaning surface and a second cleaning surface connected to different positions of said frame, said first cleaning surface and said second cleaning surface moving simultaneously with movement of said frame, said automated cleaning device periodically moving said frame to move said first cleaning surface by said charging device and simultaneously move said second cleaning surface by said charge patterning device to simultaneously clean said charging device and said charge patterning device.

2. The printing apparatus according to claim 1, said second cleaning surface comprising a brush positioned to pass over said charge patterning device as said first cleaning surface moves by said charging device.

3. The printing apparatus according to claim 2, said charge patterning device comprising an outer covering, said brush having a shape and size that match said outer covering of said charge patterning device.

4. The printing apparatus according to claim 2, said printing apparatus producing debris, said brush removing said debris from said charge patterning device.

5. The printing apparatus according to claim 4, said brush comprising a rotating fibrous surface having fibers sized to catch and hold said debris.

6. The printing apparatus according to claim 2, said first cleaning surface comprising brushes that contact said charging device while said brush is contacting said charge patterning device.

7. The printing apparatus according to claim 1, said charging device and said charge patterning device being positioned in sufficiently close proximity to one another to allow said automated cleaning device to simultaneously clean said charging device and said charge patterning device.

8. A printing apparatus comprising:

a charging device;

a photoreceptor adjacent said charging device, said charging device transferring a charge to said photoreceptor;

a charge patterning device adjacent said photoreceptor, said charge patterning device patterning said charge on said photoreceptor to form a latent image charge;

a marking material donor device adjacent said photoreceptor, said marking material donor device transferring marking material to areas of said photoreceptor having said latent image charge, such that said marking material is patterned into an image pattern according to said latent image charge on said photoreceptor;

a sheet transport device adjacent said photoreceptor, said sheet transport device supplying at least one sheet of media to said photoreceptor, said photoreceptor transferring said marking material to said sheet of media in said image pattern;

a heating device adjacent said photoreceptor, said heating device permanently attaching said marking material to said sheet of media in said image pattern; and an automated cleaning device adjacent said charging device and said charge patterning device, said automated cleaning device comprising a frame, and a first cleaning surface and a second cleaning surface connected to different positions of said frame, said first cleaning surface and said second cleaning surface moving simultaneously with movement of said frame, said automated cleaning device periodically moving said frame to move said first cleaning surface by said charging device and simultaneously move said second cleaning surface by said charge patterning device to simultaneously clean said charging device and said charge patterning device.

9. The printing apparatus according to claim 8, said second cleaning surface comprising a brush positioned to pass over said charge patterning device as said first cleaning surface moves by said charging device.

10. The printing apparatus according to claim 9, said charge patterning device comprising an outer covering, said brush having a shape and size that match said outer covering of said charge patterning device.

11. The printing apparatus according to claim 9, said printing apparatus producing debris from said sheet of media and said marking material that collects on said charge patterning device, said brush removes said debris from said charge patterning device.

12. The printing apparatus according to claim 11, said brush comprising a rotating fibrous surface having fibers sized to catch and hold said debris.

13. The printing apparatus according to claim 9, said first cleaning surface comprising brushes that contact said charging device while said brush is contacting said charge patterning device.

14. The printing apparatus according to claim 8, said charging device and said charge patterning device being positioned in sufficiently close proximity to one another to allow said automated cleaning device to simultaneously clean said charging device and said charge patterning device.

15. A printing apparatus comprising:

a corona charging device;

a photoreceptor adjacent said corona charging device, said corona charging device transferring a charge to said photoreceptor;

a raster output scanner adjacent said photoreceptor, said raster output scanner device patterning said charge on said photoreceptor to form a latent image charge;

a marking material donor roll adjacent said photoreceptor, said marking material donor roll transferring marking material to areas of said photoreceptor having said latent image charge, such that said marking material is patterned into an image pattern according to said latent image charge on said photoreceptor;

a sheet transport device adjacent said photoreceptor, said sheet transport device supplying at least one sheet of media to said photoreceptor, said photoreceptor transferring said marking material to said sheet of media in said image pattern;

a fuser adjacent said photoreceptor, said fuser permanently attaching said marking material to said sheet of media in said image pattern; and an automated cleaning device adjacent said corona charging device and said raster output scanner, said automated cleaning device comprising a frame, and a first cleaning surface and a second cleaning surface connected to different positions of said frame, said first cleaning surface and said second cleaning surface moving simultaneously with movement of said frame, said automated cleaning device periodically moving said frame to move said first cleaning surface by said corona charging device and simultaneously move said second cleaning surface by said raster output scanner to simultaneously clean said corona charging device and said raster output scanner.

16. The printing apparatus according to claim 15, said second cleaning surface comprising a brush positioned to pass over said raster output scanner as said first cleaning surface moves by said corona charging device.

17. The printing apparatus according to claim 16, said raster output scanner comprising an outer covering, said brush having a shape and size that match said outer covering of said raster output scanner.

18. The printing apparatus according to claim 16, said printing apparatus producing debris from said sheet of media and said marking material that collects on said raster output scanner, said brush removes said debris from said raster output scanner.

19. The printing apparatus according to claim 18, said brush comprising a rotating fibrous surface having fibers sized to catch and hold said debris.

20. The printing apparatus according to claim 15, said corona charging device and said raster output scanner being positioned in sufficiently close proximity to one another to allow said automated cleaning device to simultaneously clean said corona charging device and said raster output scanner.

* * * * *